United States Patent [19]

Shinn et al.

[11] 3,982,185

[45] Sept. 21, 1976

[54] LAMP BASING USING UV CURABLE ADHESIVE

[75] Inventors: Michael G. Shinn, Memphis, Tenn.; Billy G. Fransen, Opelousas, La.

[73] Assignee: General Electric Company, Schenectady, N.Y.

[22] Filed: June 25, 1975

[21] Appl. No.: 590,096

[52] U.S. Cl. ..... 339/144 R; 29/25.13; 29/25.19; 156/272

[51] Int. Cl.[2] ..... H01R 3/00

[58] Field of Search ..... 29/25.1, 25.11, 25.13, 29/25.19; 339/144 R, 144 T; 156/272; 313/318

[56] References Cited

UNITED STATES PATENTS 1,842,184 1/1932 Madden ..... 29/25.13

FOREIGN PATENTS OR APPLICATIONS 567,776 3/1945 United Kingdom ..... 156/272

*Primary Examiner*—Roy Lake
*Assistant Examiner*—James W. Davie
*Attorney, Agent, or Firm*—Paul F. Wille; Lawrence R. Kempton; Frank L. Neuhauser

[57] ABSTRACT

A process is disclosed for using ultraviolet curing adhesives to join a wire lamp to its base comprising the steps of cooling the wire lamps, applying the adhesive to either the wire lamp or the warmed base, attaching the base to the wire lamp, and curing the adhesive with incident ultraviolet radiation.

8 Claims, 3 Drawing Figures

LAMP BASING USING UV CURABLE ADHESIVE

BACKGROUND OF THE INVENTION

This invention relates to electric lamp making and, in particular, to a process for attaching the bases to wire lamps.

For the past 40 to 50 years, lamps have been made using an alcohol soluble basing cement. The cement is mixed; the lamp bases are filled and temporarily stored until needed in the lamp-basing machine. A difficulty with this procedure is that the cement mixing and base-filling operations are batch processes, whereas a continuous process is preferred. The separate operations are necessary since the cement and the filled bases have a limited shelf life, requiring careful coordination of all of the lamp-basing equipment. While the shelf life of the filled bases can be extended by refrigeration, this adds to the energy requirements of the system.

In general, the separate operations require more handling than is desirable; for example, some bases are damaged or soiled during the base-filling operation. Another broader consideration is the energy used in the basing operation. The basing cement generally used requires heat for curing, typically supplied by gas burners. With the increasing scarcity of this resource, it is desirable to find a way to reduce its consumption.

SUMMARY OF THE INVENTION

In view of the foregoing, it is therefore an object of the present invention to provide a new lamp-basing process capable of continuous operation.

Another object of the present invention is to reduce base handling and damage prior to the basing operation.

A further object of the present invention is to provide an improved lamp-basing method utilizing a non-heat curing adhesive.

The foregoing objects are achieved in the present invention wherein, at successive stations on a closed loop system, wire lamps are received, an ultraviolet (UV) curable adhesive is applied and the wire lamps are joined to the bases, UV radiation is applied to bond the two together, the wire leads are soldered or spot-welded to the base, and the lamps are removed. Alternatively, the adhesive can be applied to the base.

BRIEF DESCRIPTION OF THE DRAWINGS

A more complete understanding of the present invention can be obtained by considering the following detailed description in conjunction with the accompanying drawings, in which.

DESCRIPTION OF THE PREFERRED EMBODIMENTS

Figure 1:
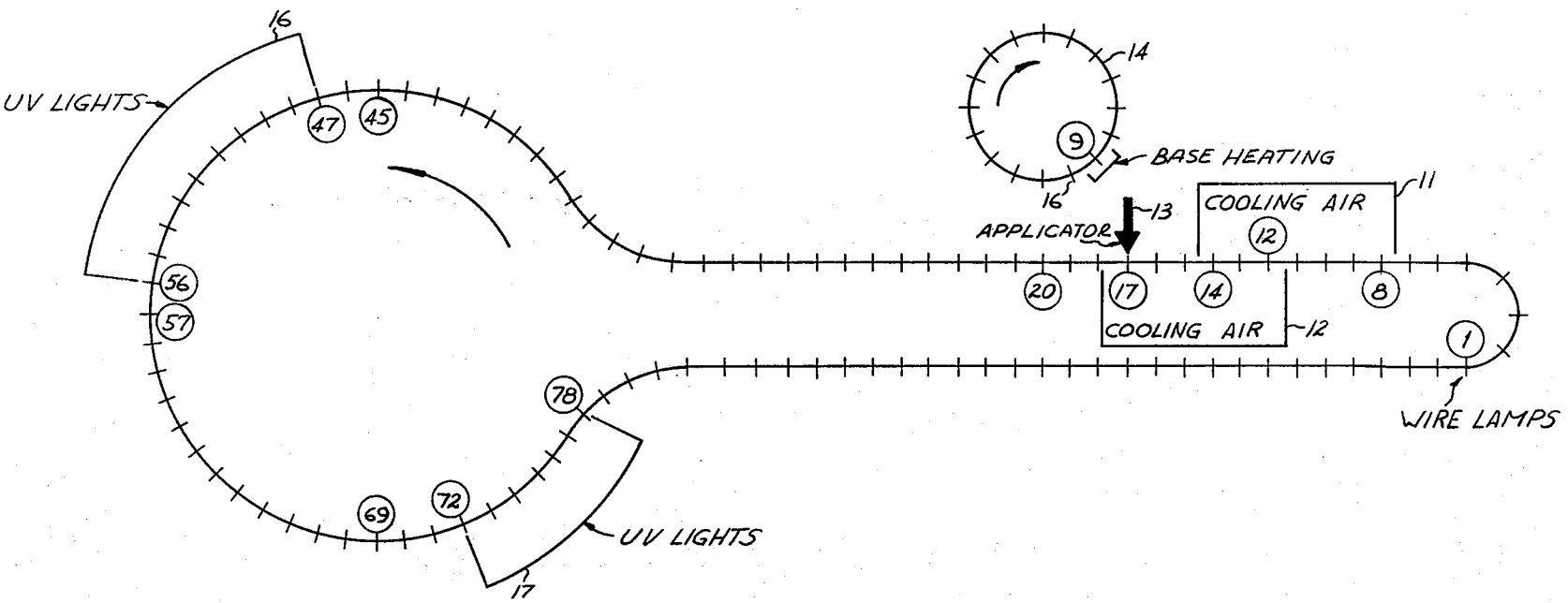
FIG. 1 illustrates the layout of the apparatus for carrying out the present invention.

FIG. 1 illustrates a preferred embodiment of the present invention in which a lamp-basing machine is schematically illustrated. The basing machine comprises a plurality of indices on a closed loop chain carrier where lamps are transferred from the lamp-sealing machine to the basing unit at index 1. Between index 1 and index 7, various wire positioning and continuity checkers, known per se in the art, are used.

Wire lamps transferred to the basing machine have a seal temperature of approximately 540°F at the transfer. In the basing systems of the prior art, the seal cools to approximately 210°F by the time the lamp enters the curing section, after the base and adhesive have been applied. In order to use an ultraviolet curable adhesive, it is necessary to cool the wire lamps so that the seal temperature is reduced from approximately 380°F to approximately 250°F at the adhesive application point. This is accomplished by cooling ducts 11 and 12 occupying the interval from indices 8–14 and 12–17, respectively.

After the wire lamps are cooled, the ultraviolet adhesive is applied by applicator 13 to the area around the seal of the wire lamp that will be in contact with the base. The bases are delivered from feeder 14 and applied to the wire lamps at index 20. Prior to feeding onto the wire lamp, the base is heated to approximately 150°F to promote wetting at the bulb/base interface. This is done by means of a gas fire or other suitable heat-generating apparatus at index 9 of feeder 14. It is understood throughout the description of the present invention that the numbering of particular index positions is arbitrary and represents, in effect, an instantaneous view of the basing unit.

From the base feeder, the lamps proceed to one or more ultraviolet curing sections represented by curing sections 16 and 17 in FIG. 1. Each curing section comprises one or more ultraviolet light-producing lamps positioned in a reflective enclosure to irradiate the adhesive at the lamp/base interface from many angles, thereby assuring adequate curing of the adhesives. While not part of the present invention, it is necessary to enclose the curing sections as much as possible to avoid any accidental irradiation of operating personnel.

The length of time the lamps are irradiated is determined by the speed of the carrier and the number of index positions occupied by the curing sections. As illustrated in FIG. 1, there are two spaced curing sections. The number of curing sections is not critical so long as the total exposure, the sum of the exposures in each section, is enough to provide an adequate cure. After passing through one or more of the curing sections, at a rate sufficient to produce a cure of the adhesive, the completed lamps continue from index 78 toward index 1 where the wire leads are soldered or welded, the lamp flashed and tested, and removed from the machine. These latter manipulations are well known in the art and form no part of the present invention.

The curing depends upon the intensity, duration, and wavelength of the incident radiation. Also, as is generally true of chemical reactions, the curing is somewhat dependent upon the temperature of the adhesive. The following table summarizes process parameters which must be observed in carrying out the present invention.

TABLE

| | | Range | Preferred |
|---|---|---|---|
| 1. | Seal temperature at adhesive application | <300°F | 250°F |
| 2. | Base temperature | ambient - 180°F | 150°F |
| 3. | UV curing intensity | 8–75 mW/cm² | 25 mW/cm² |
| 4. | UV wavelength | 3200–4000 A | 3650 A |

TABLE-continued

| | Range | Preferred |
|---|---|---|
| 5. Cure time | <20 sec. | 5 sec. |

Of the parameters listed, the latter three relate more to providing a practical embodiment than to an actual limitation on the operability of the system. For example, the intensity of the UV radiation is determined by the type of source available, which, in turn, requires consideration of the cost and lifetime of the lamp used as well as the intensity of the output of the lamp. A lamp found useful in the curing section as described above is type No. UA-3 as manufactured by General Electric Company. Similarly, the wavelength of the UV light is chosen on the basis of practical considerations involving the effectiveness of the radiation, i.e., the sensitivity of the adhesive to a particular wavelength, and the use of UV radiation in a manufacturing environment where concern must be had for accidental exposure. Thus, the wavelength is a compromise between shorter wavelengths which are more effective but also more damaging to the eye and longer wavelengths which are less effective but less damaging to the eye. Similarly, the curing time in theory should be as short as possible to enable higher production rates. A practical value is given in the "Preferred" column. While not included in the above table, another practical limitation is the amount of adhesive used per lamp, since the adhesive adds to the cost of the lamp. In general, it is preferred that the amount of adhesive be less than 30 milligrams per lamp for a lamp having a base on the order of 3/16-inch diameter. In practice, 20 milligrams per lamp has been found to be adequate.

Any ultraviolet curable adhesive fulfilling the parameters listed in the table can be utilized in implementing the present invention. For example, X-353 and LO-270 adhesives, as manufactured by Loctite Corporation, have been found suitable for use in the present invention.

Figure 2:
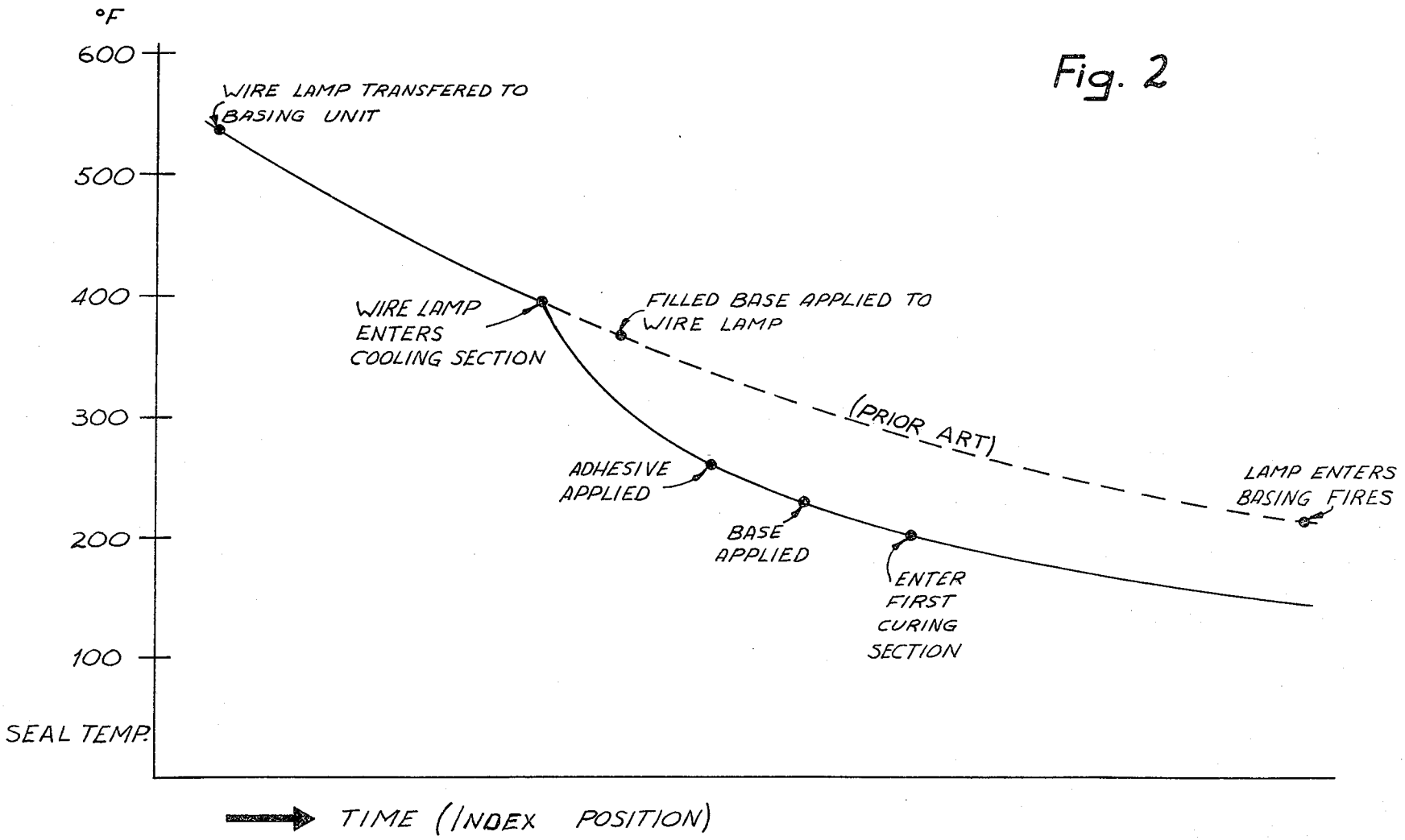
FIG. 2 is a temperature vs. time curve for the process of the present invention.

As previously indicated, the lamp temperature in the process of the present invention follows a different cooling curve from that of the prior art. As illustrated in FIG. 2, the wire lamp transferred to the basing unit has a seal temperature of approximately 540°F. During the handling between index 1 and index 8, the seal temperature cools to approximately 380°. In the process of the present invention, additional cooling is provided to reduce the wire lamp seal temperature to below 250°. Prior to being applied to the wire lamp, the base is warmed to about 150°F and the base and wire lamp enter the curing section at approximately 150°F. The curing of the adhesive depends somewhat upon the temperature thereof. It has been found that maintaining a temperature of about 150°F is adequate. This temperature is easily maintained since it is not considerably higher than ambient and since the UV lamps provide some heating in their immediate area. As can be readily seen from FIG. 2, the heat requirements of the process in accordance with the present invention are reduced compared to those of the prior art. In particular, the use of gas fires is considerably reduced.

Figure 3:
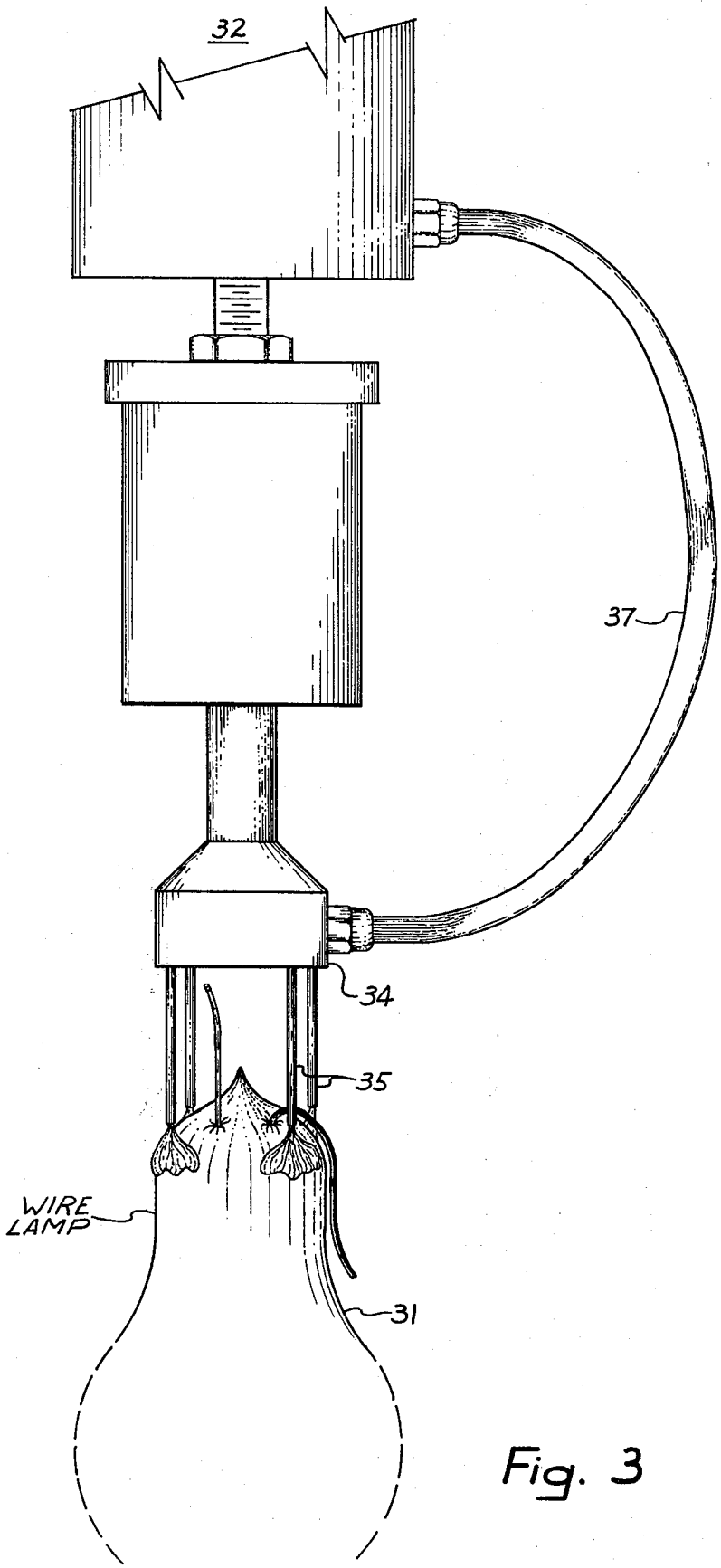
FIG. 3 illustrates an adhesive applicator in accordance with the present invention.

FIG. 3 illustrates an applicator for use in the present invention for applying the ultraviolet curable adhesive to the base area of the wire lamp. As wire lamp 31 is indexed under applicator 32, head 34 having a plurality of needle tips 35 extends down to wire lamp 31 and deposits a measured amount of adhesive thereon. The adhesive is supplied under pressure from a reservoir by way of flexible hose 37 to movable head 34. While illustrated as comprising four needle tips, movable head 34 may comprise, for example, three to 12 needle tips depending upon the size of the lamp base. Applicator 32 is controlled by suitable pneumatic or mechanical means, such as a Model 201 Control Console as manufactured by the Loctite Corporation. This control is a pressure/time control device for metering the amount of adhesive applied to the base of the lamp.

There is thus provided by the present invention a process utilizing ultraviolet curable adhesives to join a wire lamp to its base. In contrast with the processes of the prior art, the process of the present invention provides a continuous lamp-basing operation requiring reduced base handling and having reduced heat requirements as compared to the prior art.

While a preferred embodiment of the present invention has been shown and described, it will be appreciated by those of skill in the art that various modifications can be made within the spirit and scope of the present invention. For example, as previously indicated, the adhesive can be applied either to the base or to the wire lamp. Also, while a flame may be utilized for warming the bases as illustrated in FIG. 1, for example, an infrared lamp may be utilized instead.

What we claim as new and desire to secure by Letters Patent of the United States is:

1. A process for joining a base to a wire lamp comprising the steps of:

cooling the seal area of said wire lamp to less than 300°F;

warming said base to a temperature above ambient and below 180°F;

applying an ultraviolet curable adhesive to one of said wire lamp and base;

applying said base to said wire lamp; and curing said adhesive by irradiation with ultraviolet light to bond said base to said wire lamp.

2. The process as set forth in claim 1 wherein said curing step comprises:

irradiating said base and lamp with ultraviolet light having a wavelength of from 3200 A to 4000 A and an intensity of 8 to 75 milliwatts per square centimeter; and removing said base and lamp from said radiation after a total exposure of no more than 20 seconds.

3. The process as set forth in claim 2 wherein said irradiation step comprises:

moving said lamp and base past a plurality of spaced ultraviolet light sources to provide intermittent irradiation.

4. The process as set forth in claim 1 wherein the seal area of said wire lamp is cooled to approximately 250°F and said base is warmed to approximately 150°F.

5. The process as set forth in claim 4 wherein said curing step comprises:

irradiating said base and lamp with ultraviolet light having a wavelength of approximately 3650 A and an intensity of 25 milliwatts per square centimeter for a total exposure time of 5 seconds.

6. The process as set forth in claim 1 wherein said adhesive is applied to the stem area of the wire lamp.

7. The process as set forth in claim 1 wherein said adhesive is applied to the base.

8. The product formed by the process of claim 1.

* * * * *